US012473825B2

(12) United States Patent
Werkheiser et al.

(10) Patent No.: US 12,473,825 B2
(45) Date of Patent: Nov. 18, 2025

(54) WIRELESS TELEMETRY USING A PRESSURE SWITCH AND MECHANICAL THRESHOLDING OF THE SIGNAL

(71) Applicant: Halliburton Energy Services, Inc., Houston, TX (US)

(72) Inventors: Gregory Thomas Werkheiser, Carrollton, TX (US); Michael Linley Fripp, Singapore (SG); Matthew Arran Willoughby, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/731,240

(22) Filed: Jun. 1, 2024

(65) Prior Publication Data

US 2024/0318550 A1 Sep. 26, 2024

Related U.S. Application Data

(62) Division of application No. 17/134,863, filed on Dec. 28, 2020, now Pat. No. 12,000,274.

(51) Int. Cl.
*E21B 47/18* (2012.01)
*E21B 47/12* (2012.01)

(52) U.S. Cl.
CPC ..... *E21B 47/18* (2013.01); *E21B 47/138* (2020.05)

(58) Field of Classification Search
CPC ..... E21B 47/12; E21B 47/138; E21B 47/14; E21B 47/18; E21B 47/20; E21B 47/22; E21B 47/24
See application file for complete search history.

(56) References Cited

U.S. PATENT DOCUMENTS 2,838,629 A * 6/1958 Panzenhagen ..... H01H 3/24 200/83 Z
2,961,508 A * 11/1960 Minneci ..... H01H 33/55 200/83 R
3,964,556 A * 6/1976 Gearhart ..... E21B 47/0236 175/45
4,689,775 A 8/1987 Scherbatskoy
(Continued)

FOREIGN PATENT DOCUMENTS

CA 3106760 10/2023
DK 202370184 5/2023
(Continued)

OTHER PUBLICATIONS

"CA Application No. 3,106,760, Second Examiner's Report", Oct. 27, 2022, 3 pages.
(Continued)

*Primary Examiner* — Franklin D Balseca
(74) *Attorney, Agent, or Firm* — DeLizio, Peacock, Lewin & Guerra LLP

(57) ABSTRACT

Systems and methods for wireless downhole telemetry are provided. The system includes a tubular located in a wellbore; a pressure controller located at or near a surface of the wellbore to send a digital command via a change in a pressure applied to the tubular; and a receiver disposed in the wellbore, wherein the receiver includes a mechanical pressure switch to detect the change in the pressure applied to the tubular.

8 Claims, 6 Drawing Sheets

(56) References Cited

U.S. PATENT DOCUMENTS

| | | | | |
|---|---|---|---|---|
| 5,001,317 | A | 3/1991 | Atkinson et al. | |
| 5,113,379 | A * | 5/1992 | Scherbatskoy | E21B 47/12 367/83 |
| 5,438,320 | A | 8/1995 | Taylor | |
| 5,660,238 | A | 8/1997 | Earl et al. | |
| 5,806,612 | A | 9/1998 | Vorhoff et al. | |
| 6,105,690 | A | 8/2000 | Biglin, Jr. et al. | |
| 6,255,609 | B1 | 7/2001 | Samuelson et al. | |
| 6,310,829 | B1 | 10/2001 | Green et al. | |
| 6,321,838 | B1 | 11/2001 | Skinner | |
| 6,830,080 | B2 | 12/2004 | Nanaji et al. | |
| 9,482,072 | B2 | 11/2016 | Fripp et al. | |
| 9,739,120 | B2 | 8/2017 | Murphree et al. | |
| 9,752,414 | B2 | 9/2017 | Fripp et al. | |
| 10,174,610 | B2 | 1/2019 | Kyle et al. | |
| 11,371,343 | B2 * | 6/2022 | Greci | E21B 47/20 |
| 11,583,002 | B2 * | 2/2023 | Zhu | A24F 40/51 |
| 11,634,983 | B2 | 4/2023 | Werkheiser et al. | |
| 12,000,274 | B2 | 6/2024 | Werkheiser et al. | |
| 2010/0212963 | A1 | 8/2010 | Gopalan et al. | |
| 2013/0250728 | A1 | 9/2013 | Burgess | |
| 2018/0347314 | A1 | 12/2018 | Hardesty et al. | |
| 2020/0347702 | A1 | 11/2020 | Duggan et al. | |
| 2022/0205358 | A1 | 6/2022 | Werkheiser et al. | |
| 2024/0318549 | A1 | 9/2024 | Werkheiser et al. | |

FOREIGN PATENT DOCUMENTS

| | | |
|---|---|---|
| GB | 2614175 | 6/2023 |
| JP | 2004288575 | 10/2004 |
| NO | 20230265 | 3/2023 |
| WO | 2022147392 | 7/2022 |

OTHER PUBLICATIONS

"CA Application No. 3106760, First Examiner's Report", Mar. 24, 2022, 3 pages.

"DK Application No. PA 2023 70184, 1st Technical Examination Report", Mar. 18, 2024, 9 pages.

"PCT Application No. PCT/US2021/072547, International Preliminary Report on Patentability", Jul. 13, 2023, 7 pages.

"PCT Application No. PCT/US2021/072547, International Search Report and Written Opinion", Mar. 24, 2022, 10 pages.

"U.S. Appl. No. 17/134,863, Non-Final Office Action", Dec. 27, 2022, 11 pages.

"U.S. Appl. No. 17/134,863, Non-Final Office Action", Aug. 23, 2023, 12 pages.

"U.S. Appl. No. 17/134,863, Restriction Requirement", Oct. 21, 2022, 7 pages.

"U.S. Appl. No. 17/134,863 Final Office Action", Feb. 3, 2023, 11 pages.

"GB Examination Report for Application No. GB2304464.7", Jun. 20, 2024, 2 pages.

"DK Application No. PA 2023 70184 Examination Report", Oct. 15, 2024, 8 pages.

"U.S. Appl. No. 18/679,975 Non-Final Office Action", Feb. 26, 2025, 18 pages.

* cited by examiner

WIRELESS TELEMETRY USING A PRESSURE SWITCH AND MECHANICAL THRESHOLDING OF THE SIGNAL

This application is a divisional of U.S. application Ser. No. 17/134,863, filed Dec. 28, 2020, now U.S. Pat. No. 12,000,274, which is incorporated herein by reference in its entirety.

BACKGROUND

This disclosure describes downhole wireless telemetry using a pressure switch and mechanical thresholding. Once a wellbore has been at least partially drilled, there is often a need to transmit data to one or more devices or sensors located in the wellbore. In a completed well, several methods have been used involving varying complexity and cost. For example, in some instances, wires are run via well string from the surface to downhole devices and sensors to provide power and/or telemetry. Such wired completions, while ideal, are often complex and, therefore, have a higher price point. Also, in portions of the wellbore where hydraulic fracturing is to be performed, the wires can be inadvertently damaged, reducing their usefulness. Alternatively, acoustic telemetry has been used. However, acoustic telemetry requires sufficient power to be continually supplied to downhole transducers using one or more batteries. As completed, and ultimately producing, wells are required to be operational for 20 to 30 years, it is difficult to develop systems that can maintain battery life for that length of time.

BRIEF DESCRIPTION OF THE DRAWINGS

One or more embodiments of the disclosure may be better understood by referencing the accompanying drawings.

DESCRIPTION

The description that follows includes example systems, methods, and techniques that embody aspects of the disclosure. However, it is understood that this disclosure may be practiced without these specific details. In some instances, well-known instruction instances, protocols, structures, and techniques have not been shown in detail in order not to obfuscate the description.

In downhole systems there often the need for a simple, lower-power, and low-cost solution for wireless telemetry from the surface to one or more downhole receivers, and ultimately to one or more downhole tools or sensors. Delivery of a digital command wirelessly with only power initially provided at the surface avoids or minimizes the need of constantly powered devices downhole, thereby potentially extending the life and usefulness of downhole batteries and downhole tools and sensors. Minimization of power consumption can be particularly useful in completed wells, where downhole tools or sensors may need to be accessed or used over the life of a well, e.g., 20-30 years.

As described herein, in one or more embodiments, a digital command can be sent from the surface to a downhole device, via a surface transmitter and one or more downhole receivers, by changing the pressure in a tubular, e.g., casing, a work string, an annulus, or the like. The pressure changes can be detected by one or more mechanical pressure switch disposed in a downhole receiver to actuate one or more downhole electronics. In at least one embodiment, no or little power is used while the downhole electronics are waiting for activation of the mechanical pressure switch, thus minimizing or eliminating energy required during a time when a downhole connected to the electronics is waiting for actuation. Once powered, the electronics can receive one or more encoded commands via pressure changes detected by the mechanical pressure switch. The commands can actuate or activate one or more downhole tools or sensors.

Figure 1:
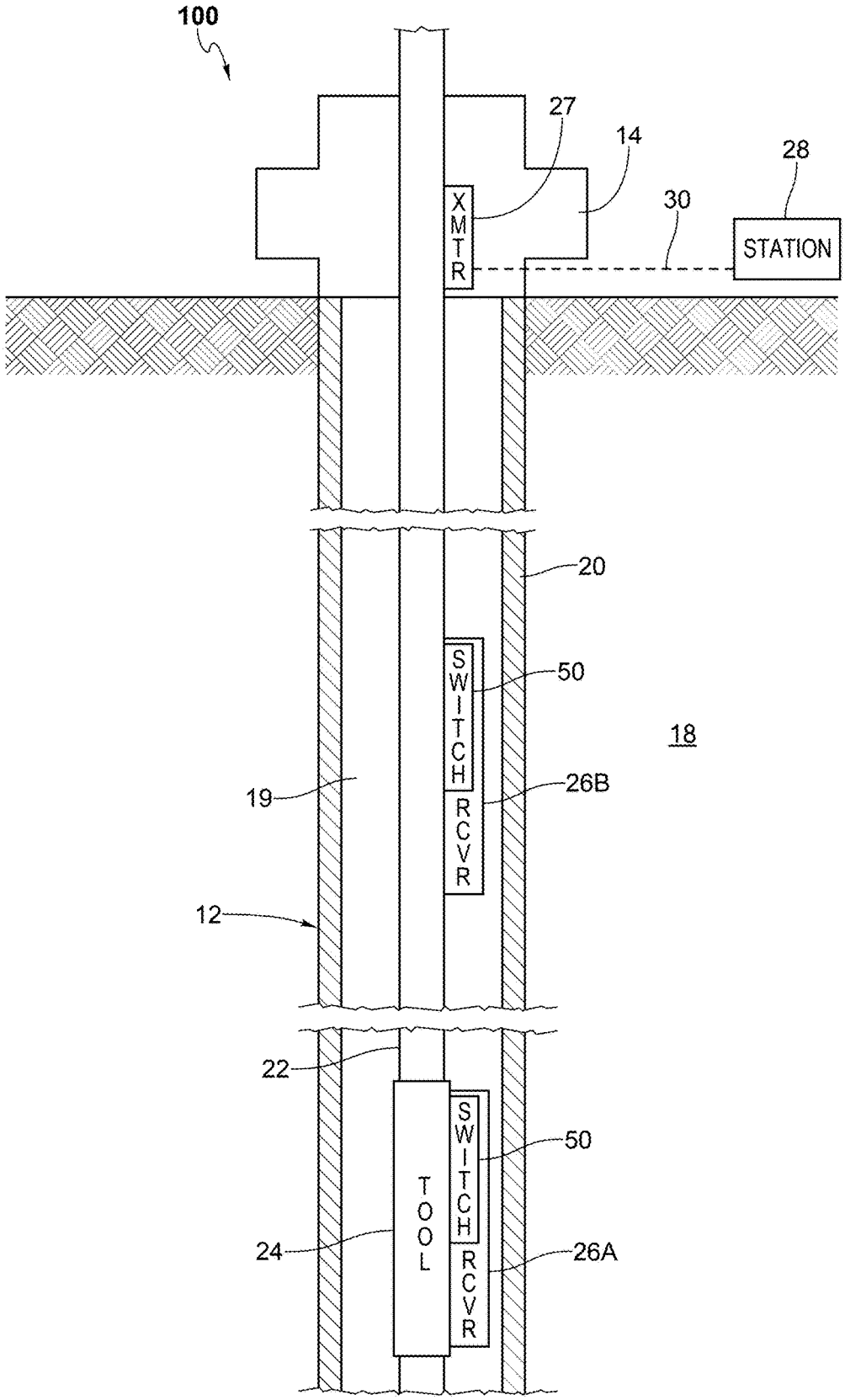
FIG. 1 depicts a schematic partially cross-sectional view of a well system, according to one or more embodiments.

FIG. 1 depicts a schematic partially cross-sectional view of a well system 100, according to one or more embodiments. The well system 100 includes a substantially cylindrical wellbore 12 extending from a wellhead 14 at the surface 16 downward into the Earth into a subterranean formation 18 (one zone is shown). The wellbore 12 extending from the wellhead 14 to the subterranean formation 18 is lined with lengths of tubing, called casing 20, to form a tubular located in the wellbore 12 and extending the length of the wellbore 12 or at least a portion thereof. Although one casing 20 is shown, the well system 100 may have multiple layers of casing radially disposed about casing 20. A well string 22 is shown as having been lowered from the surface 16 into the wellbore 12. The well string 22 is a series of jointed lengths of tubing coupled together end-to-end and/or a continuous (i.e., not jointed) coiled tubing (either referred to as a "tubular"), and can include one or more well tools 24 (one shown). The depicted well system 100 is a vertical well, with the wellbore 12 extending substantially vertically from the surface 16 to the subterranean formation 18. The concepts herein, however, are applicable to many other different configurations of wells, including horizontal, slanted or otherwise deviated wells, and multilateral wells with legs deviating from an entry well.

The well system 100 is also shown having a well telemetry system for sending and receiving telemetric communication signals via the well string 22. The well telemetry system includes a transmitter 27, one or more receivers 26 (two receivers 26A and 26B are shown, but can include one, three, or four or more), and a surface telemetry station 28. The transmitter 27 can be located at or near the surface 16. In one or more embodiments, at least one of the one or more receivers 26 is disposed in the wellbore 12. For example, the one or more receivers 26 can be disposed within the casing 20, e.g., disposed on the well string 22 to be exposed to an annulus 19 formed between the casing 20 and the well string 22. In another example, the one or more receivers 26 can be disposed on the well string 22 and exposed to the inside diameter (ID) of the well string 22 and thereby pressure changes in the well string 22. The one or more receivers 26 can receive communication signals via the annulus 19 and/or from the well string 22. In some instances, the well telemetry system is communicably coupled or otherwise associated with the well tool 24 to decode communications to the well tool 24. In one or more embodiments, communication to the well tool 24 is received at receiver 26A, transformed to an electrical signal, decoded by electronics in receiver 26A, and communicated to the well tool 24. Additional in-well type telemetry elements (not shown) can be provided for communication with other well tools, sensors and/or other components in the wellbore 12. Although shown on the well string 22 and well tool 24, the receivers 26 of the telemetry system can be additionally or alternatively provided on other components in the well, including the casing 20. The receivers 26A, 26B can receive communication from the surface telemetry station 28 outside of the wellbore 12. For example, the transmitter 27 is electrically coupled to the surface telemetry station 28 via a wired connection 30 or wireless connection, and commands from the surface telemetry station 28 can be transmitted to the receivers 26A and 26B.

The transmitter 27 is located at or near the surface 16 to send one or more digital commands to the one or more receivers 26. In one or more embodiments, the transmitter 27 is a pressure controller, e.g., a pump that applies pressure or a valve that controls application or release of pressure to fluid in a downhole tubular. In one or more embodiments, at least one of the one or more digital commands is sent via a change in pressure applied to a tubular, e.g., via pressure applied to the casing 20 and/or via pressure applied to the well string 22. At least one of the one or more receivers 26 can detect the pressure change applied to the tubular. In at least one or more embodiments, at least one of the one or more receivers 26 disposed within the tubular includes a mechanical pressure switch 50 to detect the change in the pressure applied to the tubular. For example, the mechanical pressure switch 50 can detect a pressure change in the annulus 19, can detect a pressure change in the well string 22, or both. Based on the pressure change, the mechanical pressure switch 50 can create an electrical connection. For example, the mechanical pressure switch 50 can create an electrical connection with the well tool 24 based on the pressure change. The mechanical pressure switch 50 does not require electronic power to be connected thereto in order to be actuated.

In one or more embodiments, a single receiver 26 has more than one mechanical pressure switch 50. Having a plurality of switch can be advantageous in that more than one mechanical pressure switch 50 can provide redundancy. For example, two mechanical pressure switches 50 can be located close to one another, e.g., co-located at the same depth in the wellbore 12, but have slightly different pressure thresholds thus allowing for a range of actuation pressures. Alternatively, a plurality of mechanical pressure switches 50 can be used with the same electronics, wherein each switch has different pressure thresholds, e.g., triggered at different pressure levels. This can allow more data to be sent in a shorter amount of time and also can allow for more complex instructions. For example, a first action can occur at a first pressure level, a second action can occur at a second pressure level, and a third action can occur once both the first and second pressure levels have been exceeded. Coupling this feature with timing of pressure pulses, as further described below, allows even more complexity. In one or more embodiments, each of a plurality of mechanical pressure switches 50 in a single receiver 26 can be connected to a different downhole tool or sensor. If each mechanical pressure switch 50 has a different pressure threshold, then plurality of tools can be easily actuated with a single receiver.

The mechanical pressure switch 50 can be configured in various ways so as to be sensitive to a pressure applied to the well string 22 or the annulus 19. The mechanical pressure switch 50 can be configured in multiple ways to accomplish this.

Figure 2:
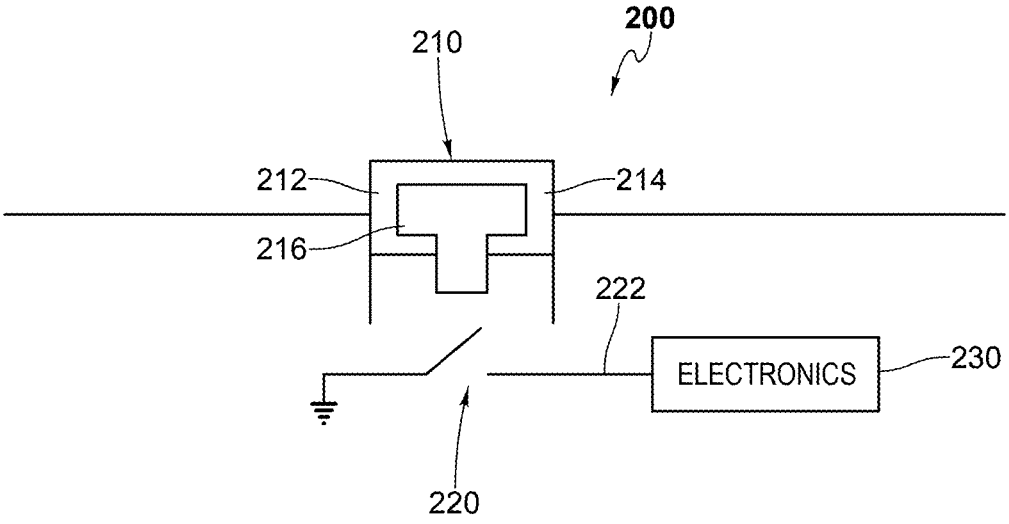
FIG. 2 depicts schematic of a mechanical pressure switch, according to one or more embodiments.

FIG. 2 depicts schematic of a mechanical pressure switch 200, according to one or more embodiments. In one or more embodiments, the mechanical pressure switch 200 has a diaphragm 210 coupled to an enclosure 212. The enclosure 212 can have an internal cavity 214 that at least partially houses a piston 216, wherein the piston 216 is axially disposed above a switch 220. The switch 220 can be coupled to electronics 230. The switch 220 can be a physical switch, a magnetic switch, or the like.

In one or more embodiments, subjecting the diaphragm 210 to a pressure change, e.g., via an applied pressure to a tubular in which the mechanical pressure switch 200 is disposed, moves, i.e. deflects, the diaphragm 210 towards the piston 216. As such, the diaphragm 210 is deflectable by the pressure applied to the tubular in which the mechanical pressure switch 200 is disposed. When the pressure change is greater than a pressure threshold, i.e. a reference pressure, movement the diaphragm 210 depresses the piston 216 and closes the switch 220. In one or more embodiments, closure of the switch 220, via movement of the diaphragm 210 and the piston 216 based on a pressure change greater than the pressure threshold, creates an electrical connection, e.g., by completing an electrical circuit. For example, closing the switch 220 can create an electrical connection allowing the delivery of power to one or more circuits or downhole tools via the electronics 230. The electronics 230 can include, or be connected to, a battery. In one or more embodiments, closure of the switch 220 connects the battery to the electronics 230, one or more downhole electronic device, and/or one or more downhole tool. When the power is delivered to the electronics 230, commands from the surface can be recorded therein.

In one or more embodiments, the pressure threshold is a fixed pressure. In other embodiments, the pressure threshold is a differential pressure, e.g., from one side of a tubing to another.

In one or more embodiments, the power is disrupted when the applied pressure falls below the pressure threshold. In other embodiments, the power stays on after the applied pressure falls below the pressure threshold. In one or more embodiments, the power stays on for a fixed time period after the change to the pressure is applied to the mechanical pressure switch 200 or after the pressure falls below the pressure threshold. For example, the closing of the switch 220 via application of pressure to the diaphragm 210 can deliver power to the electronics 230. The electronics 230 can include one or more circuits that can control the time power stays on after pressure falls below the pressure threshold once the circuits have first been powered via the first application of pressure. In one or more embodiments, the electronics 230 include one or more latch circuits 222 connected to the switch 220, one or more batteries, and/or one or more downhole electronic device. The latch circuit 222 can be configured to keep the electronics 230 powered after activation of the mechanical pressure switch 200.

Figure 3:
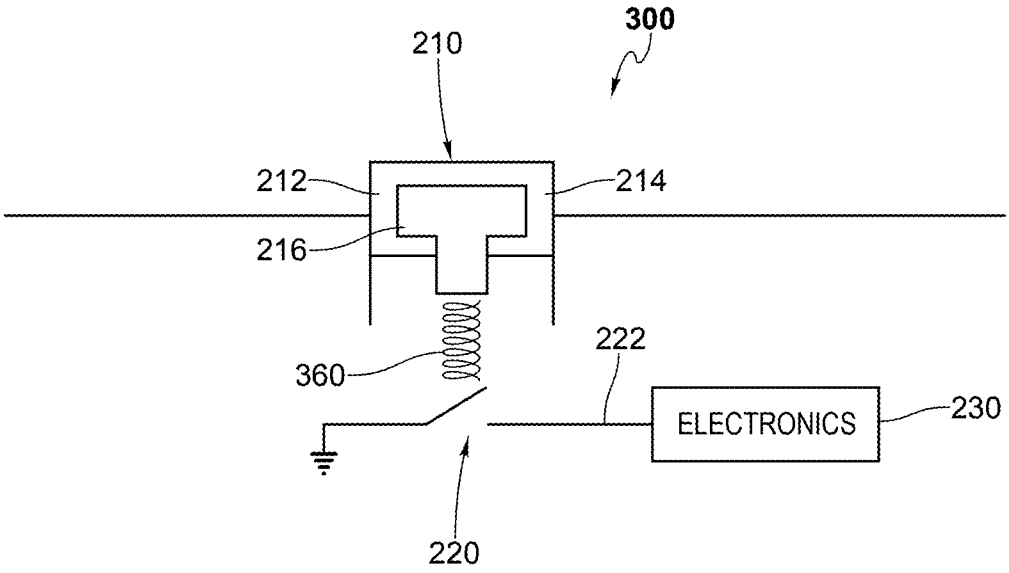
FIG. 3 depicts schematic of a mechanical pressure switch having an adjustable spring, according to one or more embodiments.

FIG. 3 depicts schematic of a mechanical pressure switch 300 having an adjustable spring 360, according to one or more embodiments. The mechanical pressure switch 300 differs from the mechanical pressure switch 200 in that the adjustable spring 360 is disposed between the switch 220 and the piston 216. The adjustable spring 360 acts against deflection of the diaphragm 210 caused by a change in applied pressure. The adjustable spring 360 can be adjusted to create a fixed pressure threshold for the mechanical pressure switch 300, i.e. the adjustable spring 360 provides the mechanical pressure switch 300 an adjustable reference pressure, i.e. an adjustable fixed pressure threshold. For example, the adjustable spring 360 can be adjusted to require more force on the piston 216 to close the switch 220, and thereby creating a higher pressure threshold. In another example, the adjustable spring 360 can be adjusted to require less force on the piston 216 to close the switch 220, and thereby creating a lower fixed pressure threshold. In one or more embodiments, the fixed pressure threshold can be set, i.e. adjusted, via the adjustable spring 260 based on an expected hydrostatic pressure or measured hydrostatic pressure in the tubular or annulus where the mechanical pressure switch 300 is to be located.

Figure 4:
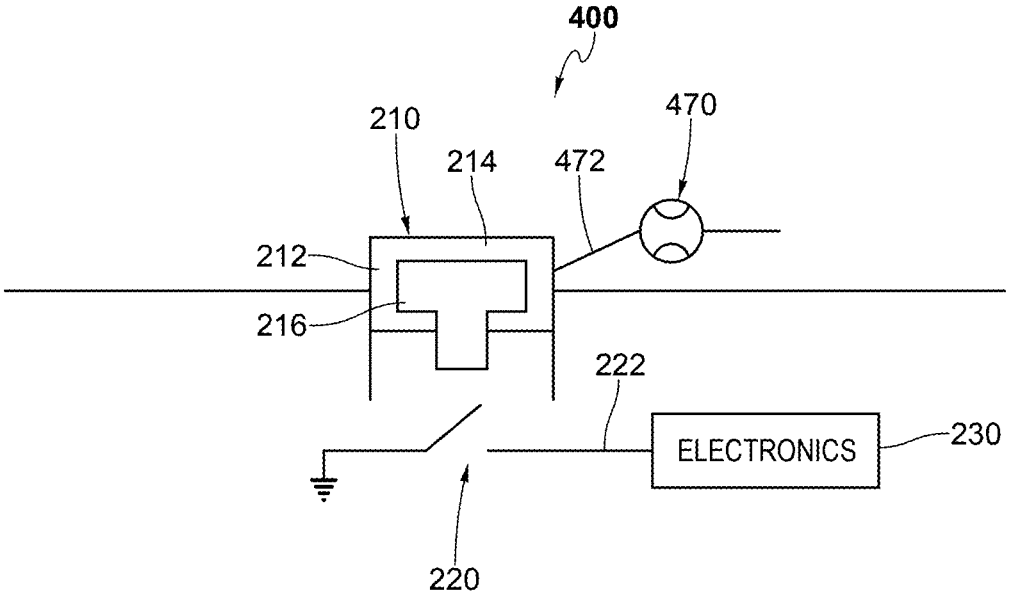
FIG. 4 depicts schematic of a mechanical pressure switch having a fluid meter, according to one or more embodiments.

FIG. 4 depicts schematic of a mechanical pressure switch 400 having a fluid meter 470, according to one or more embodiments. The mechanical pressure switch 400 differs from the mechanical pressure switch 200 in that the fluid meter 470 is connected to the enclosure 212 and the internal cavity 214 so that an outlet 472 of the fluid meter 470 acts against the deflection of the diaphragm 210 caused by a change in applied pressure. In this configuration, the applied pressure is a relative pressure, and the pressure threshold is a relative pressure threshold that is a function of the time rate of change of the applied pressure. Connecting the outlet 472 of the fluid meter 470 in this manner creates a high pass filter, allowing the mechanical pressure switch 400 to be activated with relatively rapid changes in pressure but not activated by slow changes in pressure or increases in pressure that held over a long period of time, e.g., changes to hydrostatic pressure or increases to pressure that are held over a long period of time. I.e., a quick pressure change will deflect the diaphragm 210, but a slow pressure change will not deflect the diaphragm 210 because the fluid meter 470 allows fluid to equalize around the "T" of the piston 216. This occurs because, with a rapid change in pressure, the diaphragm 210 does not have time to equalize before the diaphragm activates the switch 202. For example, if the diaphragm 210 is designed to activate the switch 220 at a specific pressure, e.g., 1000 pound-force per square inch (PSI), and the specific pressure is applied for a specific amount of time, e.g., 1 minute, then, with the fluid meter 470, the applied specific pressure will activate the switch 220 before the diaphragm 210 can equalize with the increased pressure. If pressure is applied slowly, the fluid meter 470 will balance out the pressure across the diaphragm 210 preventing the diaphragm from deflecting. As such, the fluid meter 470 creates a reference pressure on the piston facing side of the diaphragm 210 to create a reference pressure threshold.

In one or more embodiments, the fluid meter 470 allows the mechanical pressure switch 400 to auto-threshold itself and a specific hydrostatic pressure would not need to be known before disposing the mechanical pressure switch 400 downhole. In one or more embodiments, the fluid meter 470 can be used to create a high pass filter where the pressure needs to be applied for a fixed period of time before the pressure signal is detected by the mechanical pressure switch 200 (where "detected" refers to the closing of the switch 220).

In one or more embodiments, the fluid meter 470 is disposed on a reference pressure side of the diaphragm 210. For example, at static pressure, i.e. while the pressure is not changing, the pressure applied to the diaphragm 210 and the pressure on the reference pressure side will be equal. During a command, the applied pressure is increased. Due to the fluid meter 470, the reference pressure only increases slowly. Thus, the applied pressure will be higher than the relative reference pressure and the switch 220 will close. In one or more embodiments, the pressure can be communicated to the reference pressure through a bellows or piston valve in order to ensure fluid cleanliness so that the fluid meter 470 does not become plugged.

The fluid meter 470 is configured to not allow fluid to flow very quickly therethrough, i.e. the fluid meter 470 slows down the flow of fluid and/or metering the fluid. In one or more embodiments, the fluid meter 470 includes a tortuous path to slow fluid moving therethrough. For example, the fluid meter 470 can include, or even be, an orifice. In another example, the fluid meter 470 includes a fluid vortex. The fluid meter 470 can include other types of fluid meters, such as a bed of particles, a fluid diode, a tube, a solid material with reduced permeability (less than 1 Darcy but greater 1 microDarcy). In one or more embodiments, the fluid meter 470 is adjustable.

Figure 5:
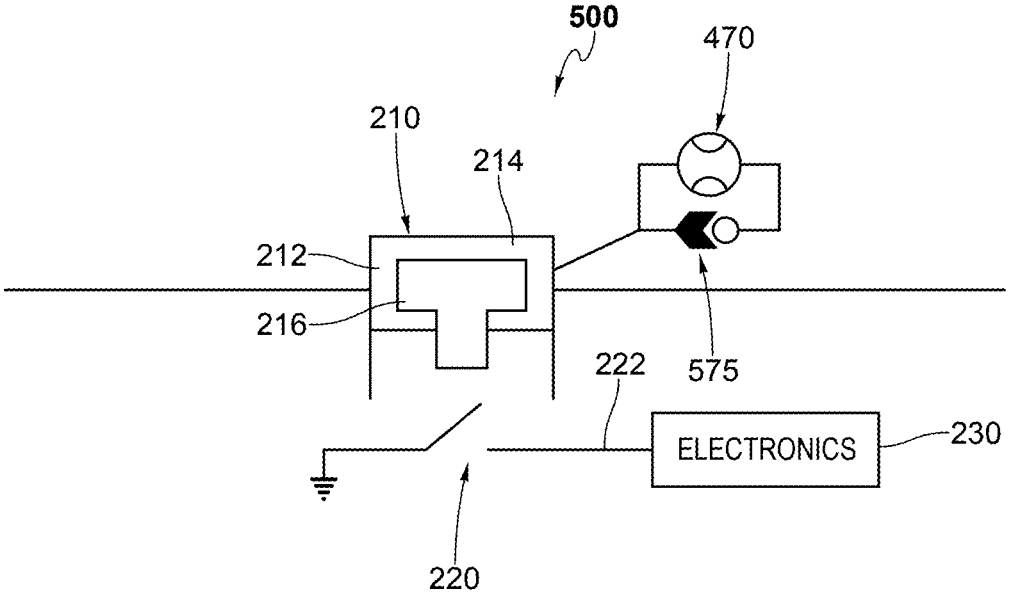
FIG. 5 depicts schematic of a mechanical pressure switch having a fluid meter and a check valve, according to one or more embodiments.

FIG. 5 depicts schematic of a mechanical pressure switch 500 having a fluid meter 470 and a check valve 575, according to one or more embodiments. Here, the fluid meter 470 and the check valve 575 are placed in parallel to allow the pressure to reset quickly once the applied pressure is lowered. The fluid meter 470 resists rises in pressure, allowing the switch 220 to activate, while the check valve 575 quickly reduces any backpressure on the diaphragm 210 if the applied pressure, e.g., pressure the surface, is bled off. Thus, the check valve 575 prevents the backpressure on the diaphragm 210 from building up if the time between pressure increases is too small. Without the check valve, the fluid has to meter back out of the fluid meter 470 to equalize the pressure with the dropping pressure.

Figure 6:
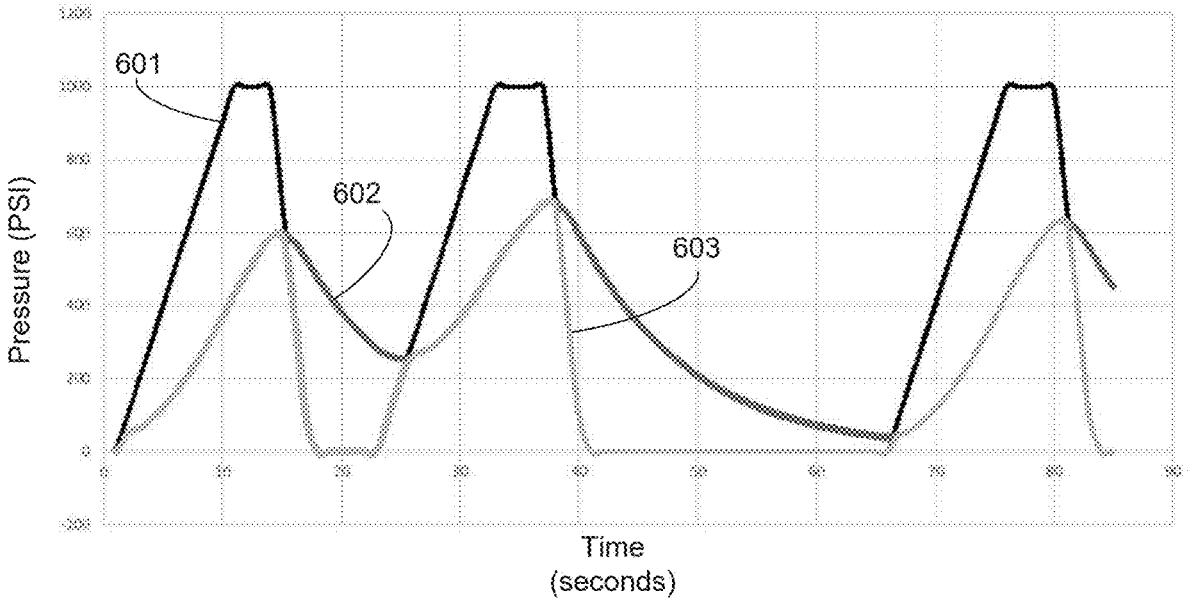
FIG. 6 depicts a graph of applied pressure and the result thereof with a switch having only a fluid meter versus a switch having both a fluid meter and a check valve, according to one or more embodiments.

FIG. 6 depicts a graph of applied pressure and the result thereof with a switch having only a fluid meter (e.g., the mechanical pressure switch 400) versus a switch having both a fluid meter and a check valve (e.g., the mechanical pressure switch 500), according to one or more embodiments. As depicted, an external pressure 601 can be applied in one or more pulses, e.g., bringing the pressure from 0 PSI to 1000 PSI as shown. As will be discussed further, the low and high pressure may vary according to the wellbore, the situation, and the use case. Without a check valve, a mechanical pressure switch having only a fluid meter (e.g., the mechanical pressure switch 400 with fluid meter 470) will have a first metered pressure 602, first resisting the rise in pressure and then resisting the rapid decrease of pressure due to the metering out of the fluid. However, a mechanical pressure switch with a check valve (e.g., the mechanical pressure switch 500 with check valve 575) will have a second metered pressure 603. As depicted the second metered pressure 603 is able to quickly drop, i.e. reset, due to the check valve's quick reduction of backpressure on the diaphragm 210.

Figure 7:
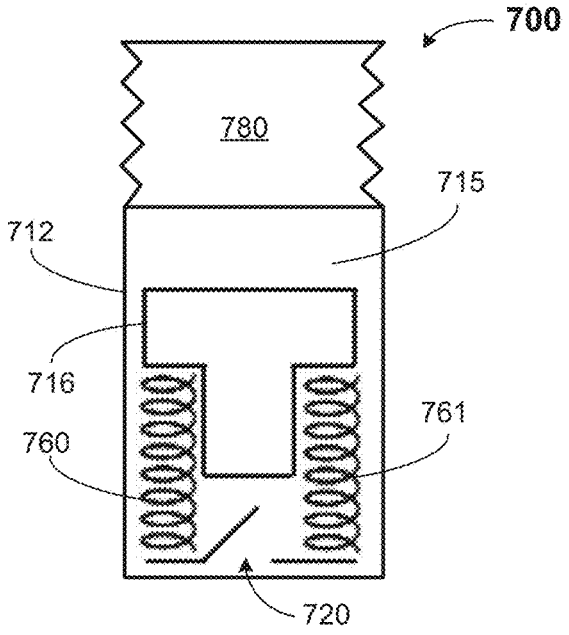
FIG. 7 depicts schematic of a mechanical pressure switch having one or more springs and a bellows, according to one or more embodiments.

FIG. 7 depicts schematic of a mechanical pressure switch 700, having one or more springs (a first spring 760 and a second spring 761 are shown) and a bellows 780, according to one or more embodiments. The bellows 780 is disposed outside the enclosure 712 adjacent a first side, or top side, of the enclosure 712. The one or more springs (e.g., including the first spring 760 and the second spring 761) may be circumferentially disposed around the piston 716. The enclosure 712 houses a piston 716, the one or more springs 760, 761, and a switch 720 in a viscous fluid 715, i.e. the enclosure is filled with the viscous fluid 715. The switch 720 is disposed inside the enclosure 712 and on a second side, or bottom side, of the enclosure 712. The one or more springs 760, 761 are disposed under the piston 716, i.e. disposed between a bottom side of the piston 716, i.e. the side of the piston 716 opposite to the bellows 780, and the second side of the enclosure 712 to create a force acting against depression of the piston 716. The one or more springs (e.g., the first spring 760 and the second spring 761) can be one or more light springs. The piston 716 is axially disposed above the switch 720 to engage the switch 720 upon axial movement of the piston 716. As with other mechanical pressure switches described herein, sufficient movement of the piston 716 closes the switch 720 to create an electrical connection, e.g., to a battery, electronics, or the like. The switch 720 can be a physical switch, a magnetic switch, or the like.

The bellows 780 is configured to be in contact with external pressure, e.g., pressure in a tubular or annulus, and to be in fluid communication with the enclosure 712. A space between the piston 716 and the enclosure 712 can be sufficiently small such that compression of the bellows 780 due to a sharp increase in applied pressure would induce a force on a top side of the piston 716, i.e. the side of the piston 716 facing the bellow 780, sufficient to move the piston 716 and close the switch 720. The viscous fluid 715 moving slowly around the piston 716 causes a higher force on the top side of the piston 716. Slow changes to the pressure applied to the bellows 780 move the bellows 780 slower, thereby lowering the force of the bellows 780 on the piston 716 below a spring force of the one or more springs 760, 761 such that there is insufficient force on the piston 716 to close the switch 720 as the viscous fluid 715 moves around slowly, equalizing the pressure. In one or more embodiments, the mechanical pressure switch 700 with the bellows 780 can have a simpler pressure response than that of a mechanical pressure switch having a fluid meter and/or a check valve. Further, fully enclosing the piston 716 in the viscous fluid 715 can simplify design requirements as this design would remove o-rings, and their associated friction, that might be required separating clean fluids from dirty fluids in the piston 716.

In one or more embodiments, the viscous fluid 715 has a very low viscosity, and applying pressure to the bellows 780 causes a deflection of the bellows 780 that pushes against the piston 716. The one or more springs then resist the motion of the piston 716, and at a sufficiently large applied pressure, the piston 716 deflects and closes the switch 720.

Figure 8:
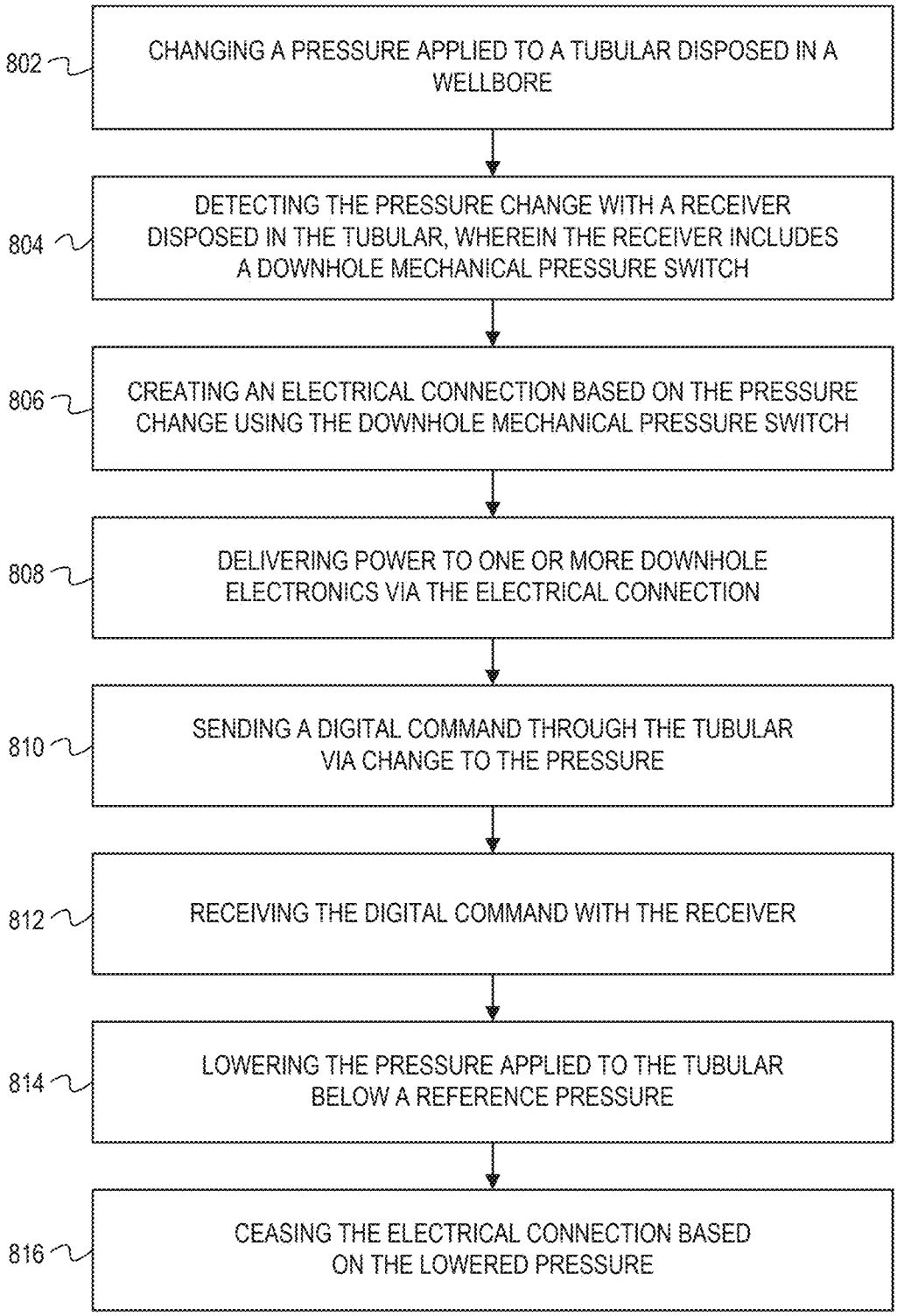
FIG. 8 depicts a method for wirelessly transmitting a command to downhole electronics, according to one or more embodiments.

FIG. 8 depicts a method 800 for wirelessly transmitting a command to downhole electronics, according to one or more embodiments. The method can be practiced with the well system 100 and can use a mechanical pressure switch, wherein the mechanical pressure switch can include any of the embodiments previously described.

At 802, the method commences with changing the pressure applied to a tubular disposed in a wellbore. The tubular can be casing (e.g., casing 20), a well string (e.g., well string 22). Applying pressure to the tubular can also include applying pressure to annulus between an outer tubular and an inner tubular, e.g., between casing and the well string. Changing the pressure applied to the tubular can include raising the pressure applied to the tubular above a pressure threshold, e.g., a reference pressure of a downhole device such as a mechanical pressure switch. In one or more embodiments, the pressure threshold can be predetermined. In one or more embodiments, changing the pressure applied to the tubular includes raising the pressure applied to the tubular above a relative reference pressure, such as when the mechanical pressure switch includes a diaphragm and fluid meter (e.g., mechanical pressure switches 400 or 500).

There are multiple ways of applying pressure to the tubular or annulus. For example, in a closed well a pump can be used to pressure up the well, i.e. to generate pressure in the tubular and/or annulus. In a flowing well, e.g., a producing well, pressure can be applied by changing a restriction at the surface.

At 804, the pressure change is detected with a receiver (e.g., receiver 26A and/or 26B) disposed in the tubular, wherein the receiver includes a mechanical pressure switch (e.g., any one of mechanical pressure switches 50, 200, 300, 400, 500, or 700 described above). In one or more embodiments, the mechanical pressure switch includes a diaphragm, a piston, and a switch, and detecting the pressure change with the receiver comprises deflecting the diaphragm to move the piston.

At 806, an electrical connection is created based on the pressure change using the mechanical pressure switch. In one or more embodiments, creating the electrical connection comprises closing the switch via movement of the piston, i.e., creating the electrical connection occurs when the applied pressure is raised above a pressure threshold. For example, raising the pressure applied to the tubular greater than the pressure threshold (i.e. a reference pressure) of the mechanical pressure switch can move the diaphragm with sufficient force to move the piston axially and close the switch of the mechanical pressure switch. The closed switch can establish an electrical connection, e.g., completing an electronic circuit.

At 808, power is delivered to one or more downhole electronics (e.g., electronics 230) via the electrical connection. In one or more embodiments, the completed circuit, established via the closed switch, includes one or more batteries. The electronics can be powered down, i.e. not having power flowing from the battery to the electronics, prior to actuation of the mechanical pressure switch, e.g., actuation via the piston closed switch.

At 810, a digital command is sent through the tubular via the change in pressure, and, at 812, the digital command is received with the receiver. A plurality of pressure changes, e.g., a series of pressure pulses or a plurality of pressure cycles, can be used to encode the digital command. In one or more embodiments, the digital command is decoded based on the plurality of pressure changes. The digital command can be encoded by the number of pressure changes, the time between the pressure changes, the duration of the pressure change, the sequence of pressure changes, etc. For example, the downhole electronics can be operationally connected to the receiver or included in the receiver to decode the digital command received by the receiver.

Figure 9:
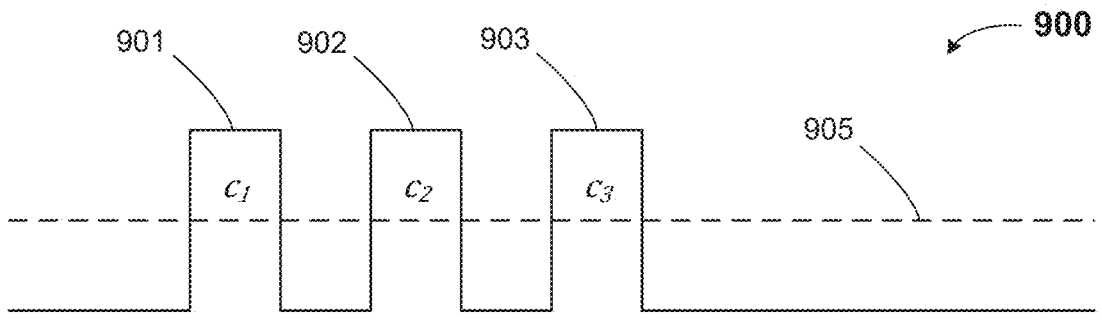
FIG. 9 depicts a first timing diagram of a first pressure cycle used to encode a digital command, according to one or more embodiments.

FIG. 9 depicts a first timing diagram of a first pressure cycle 900 used to encode a digital command, according to one or more embodiments. In one or more embodiments, the digital command is a count of the number of pressure changes, e.g., the number of pulses or pressure cycles. For example, a downhole tool can be activated, via the downhole electronics attached the mechanical pressure switch, after a fixed number of pressure pulses above a pressure threshold 905 have been applied. As depicted in the first pressure cycle 900, three pressure pulses 901, 902, 903 are shown in sequence, with each pulse getting a count, i.e. pulse 901 having count $c_1$, pulse 902 having count $c_2$, and pulse 903 having count $c_3$. As depicted, after the three pressure pulses 901, 902, 903, activation of a downhole device or tool can occur. Note, activation could also occur after a number of counted pressure cycles not just a number of counted pressure pulses.

Figure 10:
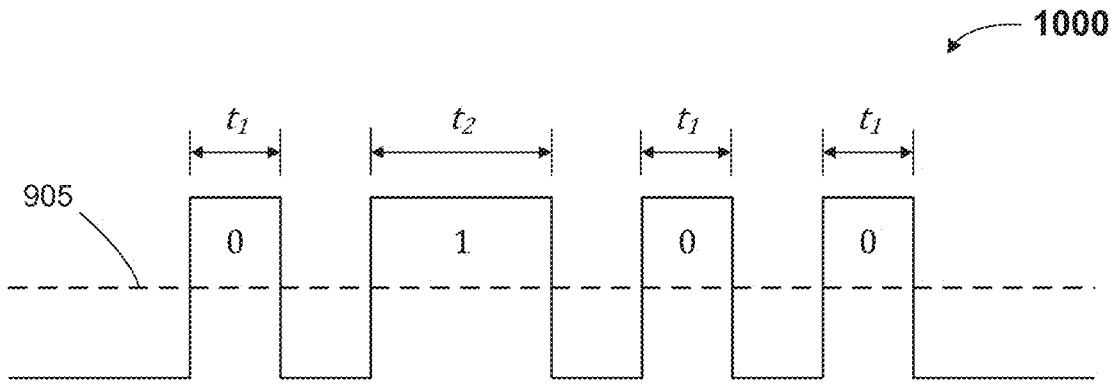
FIG. 10 depicts a second timing diagram of a second pressure cycle used to encode a digital command, according to one or more embodiments.

FIG. 10 depicts a second timing diagram of a second pressure cycle 1000 used to encode a digital command, according to one or more embodiments. In one or more embodiments, the pressure is applied above the pressure threshold 905 for a period of time and the length of time that the switch is closed is used to encode the digital command. For example, an applied pressure that is applied for a first amount of time $t_1$, e.g., 30 seconds, can be treated as a "0" while an applied pressure that is applied for a second amount of time $t_2$, e.g., 60 seconds, is treated as a "1". Note, other time increments can be chosen.

The using of timing to encode a signal can also be done in various other ways as well. For example, if the applied pressure is the same length of time as a previous applied pressure then the bit can be treated a "0", while if the applied pressure is 2× longer (or 2× shorter) in duration than the previous applied pressure, then the bit can be treated a "1". In one or more other examples of using timing to encode a digital command, the signal can be comprised of multiple time lengths, such as a command consisting of 5-15 seconds of applied pressure, followed by 20-30 seconds of applied pressure, followed by 50-60 seconds of applied pressure.

In one or more embodiments, both the count and timing of the pressure pulses or pressure cycles can be used to encode the digital signal. For example, the downhole electronics or downhole tool can count the number of pressure cycles, and this count will continue to increment unless the applied pressure exceeds a time limit. Then, when the time limit is exceeded, then the count restarts. In one implementation, the count increments if the applied pressure exceeds the reference pressure for at least 5 seconds but no longer than 60 seconds, but if the applied pressure exceeds the reference pressure for 60 seconds or longer, then the count is reset to 0. The chosen time periods here and above are merely examples, and other time periods could be used to best suit the system and transmission environment.

In one or more embodiments, including those mentioned above, the electronics do not necessarily need to the powered while the switch is not closed. For example, the downhole electronics can store and/or increment the number of pressure cycles or can store the time duration of the pressure cycle even when not powered. In one or more embodiments, when the electronics reach the required command, then a tool activates and/or power can be applied.

In one or more embodiments, the mechanical pressure switch can stay on activation for a set length of time. For example, the electronics of the mechanical pressure switch (or a tool connected thereto) can be powered down when first run in the hole, and then turned on with a first command via a change of pressure. Once activated, the electronics and/or the downhole tool can remain on for the set length of time to wait for new commands, and then automatically power down after the completion of the set amount of time to preserve battery life and/or power consumption. For example, the electronics could be powered on for 6 hours based on the first command and then automatically power down once the 6 hours have run to preserve the life of one or more batteries.

Figure 11:
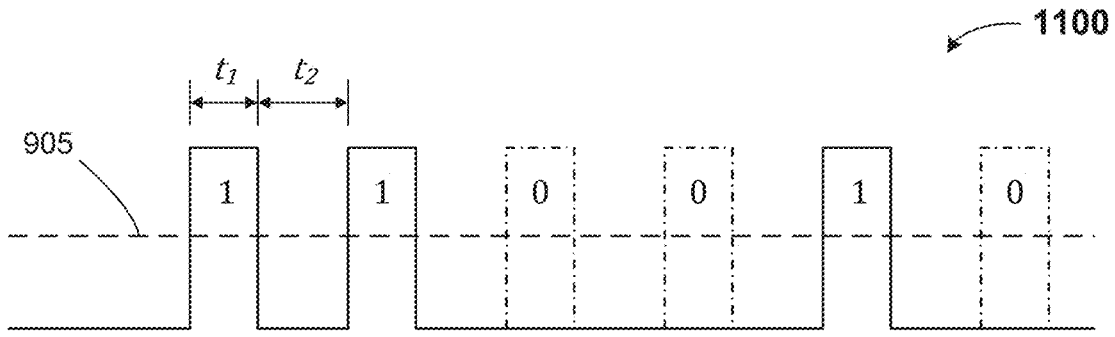
FIG. 11 depicts a timing diagram of a third pressure cycle used to encode a digital command, according to one or more embodiments.

FIG. 11 depicts a timing diagram of a third pressure cycle 1100 used to encode a digital command, according to one or more embodiments. In one or more embodiments, power is applied to the electronics for a period after the pressure changes, even after the applied pressure is no longer greater than the pressure threshold 905. This enables using encoding the signal with pulse positioning. In pulse positioning, wireless telemetry from an up-hole or surface location to the downhole location where the mechanical pressure switch can be established by holding the pressure to a first pressure, e.g., a high pressure, i.e. a pressure higher than the pressure threshold 905, for a first time $t_1$, and then holding the pressure to a second pressure, e.g., a low pressure, i.e. a pressure lower than the pressure threshold 905, for a second time $t_2$. As depicted, a data bit of 1 can be sent by holding the pressure high, i.e. a pressure above the pressure threshold 905, for the first time $t_1$, and a bit of 0 can be sent by leaving the pressure low, i.e. a pressure below the pressure threshold 905, after the second time $t_2$. Using pulse positioning, data can be sent to downhole tools from the surface to activate or start/stop some process.

Sending and receiving one or more digital commands using the mechanical pressure switch can allow selective activation and/or actuation of one or more downhole tools. In one or more embodiments, the mechanical pressure switch can be used as part of a completion system to open up one or more areas of the completion after initial run-in, e.g., for cementing, hydraulic fracturing, well-control, reservoir management, or the like. For example, the sending and receiving of one or more digital commands using the mechanical pressure switch can open up one or more frac sleeves or one or more screens. Sending and receiving of one or more digital commands using the mechanical pressure switch can open up one or more flow passages between an inner diameter (ID) and outer diameter (OD) of a tubular. In other examples, sending and receiving of one or more digital commands using the mechanical pressure switch can set one or more packers, can fire one or more perforating guns, or can communicate with remote open-close tools. In one or more embodiments, sending and receiving of one or more digital commands using the mechanical pressure switch can open an electronic toe sleeve.

In one or more embodiments, the data rate of the digital commands is slower than in mud-pulse telemetry. For example, the data rate can be measured in bits per minute as opposed to bits per second. In one or more embodiments, the data rate is slower than 1 bit/minute, slower than 1 bit/5 minutes, or slower than 1 bit/10 minutes.

In one or more embodiments, there is no power flowing between the battery and the electronics prior to the application of a pressure cycle, but then power is delivered to the electronics during a first application of pressure, e.g., a first pressure cycle or pulse above the reference pressure.

Referring again to FIG. 8, at 814, the pressure applied to the tubular can be lowered below a reference pressure, and, at 816, the electrical connection can be ceased based on the lowered pressure. In one or more embodiments, lowering the pressure can take pressure off the mechanical pressure switch, thus opening an electrical connection, thereby preventing the connection. For example, with a mechanical pressure switch having a diaphragm (as described above), a piston, and/or a switch, lowering the pressure applied to the tubular can remove force on the diaphragm, thereby removing force on the piston such that it moves away from the switch axially resulting in an open electrical connection.

In at least one embodiment, the downhole electronics stay powered for a fixed period of time after the pressure is lowered. For example, the electronics can include one or more circuits, e.g., one or more latch circuits, that will hold keep power supplied to the electronics even after the switch of the mechanical pressure switch has opened due to the raising of the piston due to the lowered pressure.

While the systems and methods above mainly describe one-way communication from a transmitter located on the surface (or nearby thereto) to a downhole receive, the same principles could apply for transmitter located downhole, e.g., to transmit back to the surface, such as could be used for two-way for communication, or use to transmit further downhole, such as used as a repeater. A downhole transmitter can have sufficient power thereto, e.g., via a battery or some other power source, to adequately provide a strong signal.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

As used herein, the term "or" is inclusive unless otherwise explicitly noted. Thus, the phrase "at least one of A, B, or C" is satisfied by any element from the set {A, B, C} or any combination thereof, including multiples of any element.

The invention claimed is:

1. A system comprising:

a tubular located in a wellbore;

a pressure controller located at or near a surface of the wellbore to send a digital command via a change in a pressure applied to the tubular; and a receiver disposed in the wellbore, wherein the receiver includes a mechanical pressure switch configured to detect a change in the pressure applied to the tubular that exceeds a change threshold within a time limit and to create an electrical connection in response to the change in the pressure that exceeds the change threshold within the time limit, wherein power is not supplied to the receiver disposed in the wellbore until there is a detected change in pressure by the mechanical pressure switch, and wherein the mechanical pressure switch comprises:

an enclosure having a first side and a second side, wherein the enclosure is filled with a viscous fluid;

a switch disposed inside the enclosure and on the second side of the enclosure;

a piston disposed in the enclosure to engage the switch upon axial movement of the piston;

a bellows disposed on the first side of the enclosure and in fluid communication with the enclosure; and one or more springs disposed between a bottom side of the piston and the second side of the enclosure.

2. The system of claim 1, further comprising:

a latch circuit connected to the mechanical pressure switch to keep electronics powered after activation of the mechanical pressure switch.

3. A method comprising:

changing a pressure applied to a tubular disposed in a wellbore;

detecting the pressure change with a mechanical pressure switch included in a receiver disposed in the tubular, the mechanical pressure switch to supply power to the receiver only upon detecting the pressure change, wherein the mechanical switch includes:

an enclosure having a first side and a second side, wherein the enclosure is filled with a viscous fluid;

a switch disposed inside the enclosure and on the second side of the enclosure;

a piston disposed in the enclosure to engage the switch upon axial movement of the piston; and one or more springs disposed between a bottom side of the piston and the second side of the enclosure; and creating an electrical connection based on the detected pressure change exceeding a change threshold within a time limit, when the piston engages the switch by compressing the springs in response to the detected pressure change by a bellows disposed on the first side of the enclosure and in fluid communication with the enclosure.

4. The method of claim 3, further comprising delivering power to one or more downhole electronics via the electrical connection.

5. The method of claim 4, wherein the power to the one or more downhole electronics is applied for a time period after the change to the pressure applied to the tubular.

6. The method of claim 5, further comprising, during the time period, holding a first pressure applied to the tubular for a first time $t_1$ and holding a second pressure applied to the tubular for a second time $t_2$.

7. The method of claim 3, further comprising:

sending a digital command through the tubular via the change to the pressure applied to the tubular.

8. The method of claim 3, further comprising:

receiving a digital command through the tubular via the change to the pressure applied to the tubular.

* * * * *